United States Patent [19]

Bolza-Schunemann

[11] 4,190,242

[45] Feb. 26, 1980

[54] GEAR FOLDER

[75] Inventor: Hans B. Bolza-Schunemann, Wurzburg, Fed. Rep. of Germany

[73] Assignee: Koenig & Bauer Aktiengesellschaft, Wurzburg, Fed. Rep. of Germany

[21] Appl. No.: 844,081

[22] Filed: Oct. 20, 1977

[30] Foreign Application Priority Data

Nov. 16, 1976 [DE] Fed. Rep. of Germany ..... 2652159

[51] Int. Cl.[2] ..... B42C 1/04

[52] U.S. Cl. ..... 270/50; 270/42; 270/77

[58] Field of Search ..... 270/76–77, 270/6, 7, 13, 14, 19, 10, 11, 38, 42, 47–50, 60, 43; 74/568

[56] References Cited

U.S. PATENT DOCUMENTS

| | | | |
|---|---|---|---|
| 2,026,515 | 12/1935 | Zuckerman | 270/6 |
| 2,137,978 | 11/1938 | Mills | 270/77 |
| 2,797,084 | 6/1957 | Hilgoe | 270/43 |
| 2,857,784 | 10/1958 | Brailsford | 74/568 |
| 3,144,249 | 8/1964 | Bryer | 270/77 |
| 3,521,878 | 7/1970 | Bolza-Schunemann | 270/72 |
| 3,787,041 | 1/1974 | Hertrich | 270/71 |
| 3,865,361 | 2/1975 | Neal | 270/76 |

*Primary Examiner*—Edgar S. Burr
*Assistant Examiner*—A. Heinz
*Attorney, Agent, or Firm*—Jones, Tullar & Cooper

[57] ABSTRACT

A gear folder for folding paper webs or sheets is provided with a cutting knife cylinder, a counter-cut groove cylinder, and a collecting and folding blade cylinder. The collecting cylinder has an odd number of fields for receipt of sheets and further includes an internal folding blade carrier having an even number of folding blades which selectively project through the periphery of the collecting cylinder to transfer a web to suitable folding rollers. Each of the fields of the collecting cylinder is provided with a pin set to retain the web on the periphery of the cylinder. The pin sets are controlled to selectively retract in conjunction with the projection of the folding blades to allow transfer of a selected sheet or stack of sheets to the folding rollers. The frequency of retraction of the pin sets and projection of the folding blades can be varied to transfer the sheets to the folding rollers after each revolution or only after several revolutions of the collecting drum.

4 Claims, 4 Drawing Figures

GEAR FOLDER

FIELD OF THE INVENTION

The present invention is directed to gear folders for use in folding webs or sheets of paper. More particularly, the present invention is directed to gear folders having a collecting cylinder and a folding blade carrier rotatably mounted within the collecting cylinder. Specifically, the present invention is directed to gear folders having means for selectably controlling the projection of the folding blades and the retraction of the pin sets on the collecting drum or cylinder whereby the collecting drum is capable of collecting several sheets at each collection field before transferring the collected sheets or sheet stacks to folding rollers at a transfer location.

A gear folder in accordance with the present invention includes a cutting knife cylinder, a cooperating counter cut groove cylinder and a collecting cylinder. The collecting cylinder has an odd number of collecting fields, each of which includes retaining pin sets. A rotating folding blade carrier is eccentrically positioned within the rotating collecting cylinder and includes an even number of folding blades. The folding blade carrier and collecting cylinder further include means for selectively controlling the projection of the blades and the retraction of the pin sets so that the collecting cylinder can collect several different sheet stacks from the cutting knife cylinder and counter cut groove cylinder thereby functioning in either straight, collect, or double collect run production.

DESCRIPTION OF THE PRIOR ART

Gear folders of various construction are generally known in the art for use with rotary printing presses. They cross-cut paper ribbons or sheets assembled by formers or turning bars and use folding blades to push the sheets into a pair of folding rollers in order to obtain the required cross-fold. This cross folding of the sheet or web may be performed after each of the cutting procedures, or only after every second cutting procedure, so that it is possible to run the rotary printing press in straight run production, as well as in collect run production. This latter production manner requires printing units in the web-fed rotary printing press, having plate cylinders which each carry two printing plates around their periphery for two cut-offs.

It is also known to utilize printing units which carry four printing plates around each plate cylinder periphery. This enables, in addition to the usual production manners hitherto known; i.e. straight run and collect run production, another new production manner which is double collect run production, where four different printing plates fixed around the plate cylinder periphery produce four different cut-offs that are all collected upon each other before the cross fold is performed. This method permits the production of very thick newspaper products in an advantageous manner by requiring only a half or a third of the prior number of paper webs. This increases the efficiency or the net output of the web-fed rotary printing press.

Gear folders which can be used for these three production manners mentioned above are generally known in the art, as may be seen in German Pat. No. 18 01 419. A disadvantage of these known folders is their complex and expensive design which may require five, six, or seven cylinders, thus causing high costs, and also requiring substantial space, so that the multiple purpose folders frequently desired for use with one paper web infeed cannot be utilized. Thus, only single folders can often be used. A further disadvantage of present gear folders is the multiple pin changes the cut sheets must go through before they are cross-folded, as much fluff or paper scrap is produced by these multiple pin changes and as the precision of high speed web runs decreases as a function of the frequency of transfers.

SUMMARY OF THE INVENTION

It is an object of the present invention to provide a gear folder which can operate in straight, collect, or double collect run production.

It is a further object of the present invention to provide a gear folder which requires less paper transfers than prior devices.

Yet another object of the present invention is to provide a gear folder which is quickly changable between straight, collect, and double collect production runs.

Still a further object of the present invention is to provide a gear folder requiring only one collecting cylinder and one folding blade assembly.

The gear folder in accordance with the present invention includes a cutting knife cylinder and a counter cut groove cylinder for severing the web into a plurality of sets of sheets. These sets of sheets are transferred to the outer periphery of a rotating collecting cylinder which preferably is comprised of five collecting fields, each field including a retractable pin set for retaining the sheet or sheets. A folding blade carrier is eccentrically mounted for rotation within the collecting cylinder and includes folding blades which are caused to project through the periphery of the collecting cylinder to transfer the stack of sheets to suitable folding rollers. Means are provided to allow the concurrent retraction of the pin sets and the projection of the folding blades in an interrelated, selectable manner to allow the collecting cylinder to operate in either straight, collect, or double collect run production.

In accordance with the present invention, there is provided a folder of uncomplicated, cost-saving, and space-saving design. No change of pin-transfer is required during and after the collecting procedure, which reduces maintenance time, adjusting time, susceptibility to trouble, and production of fluff or paper scrap, and which essentially increases reliability of operation. This is particularly important for the production of very thick newspapers of 144 or more pages. The space-saving design also permits the installation of several folders in substantially less space than prior gear folders.

BRIEF DESCRIPTION OF THE DRAWINGS

While the novel features of the gear folder in accordance with the present invention are set forth with particularity in the appended claims, a full and complete understanding of the invention may be had by referring to the description of the preferred embodiment set forth hereinafter and as may be seen in the included drawings in which:

DESCRIPTION OF A PREFERRED EMBODIMENT

Figure 1:
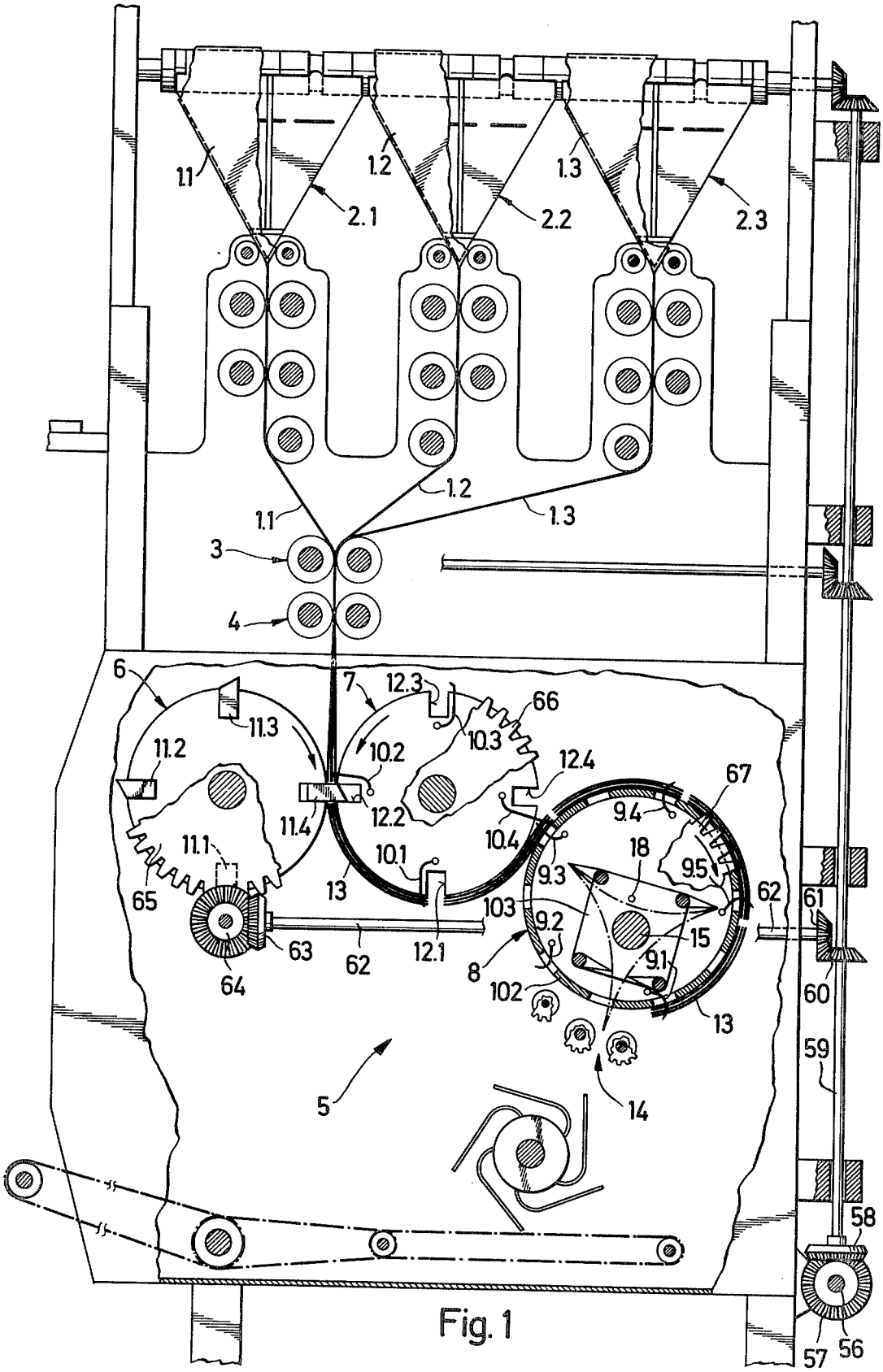
FIG. 1 is a schematic side view partly in section and with portions removed for clarity, and showing a gear folder in accordance with the present invention having a 4/2-cutting knife cylinder, a 4/2-counter cut groove cylinder, and a 5/2-collecting folding-blade cylinder.

Turning now to FIG. 1, there may be seen a gear folder in accordance with the present invention. While the gear folder will be hereinafter described in conjunction with a web fed rotary printing press, it will be understood that the gear folder could be used with other types of presses, if desired. As may be seen in FIG. 1, a plurality of longitudinally folded paper ribbons 1.1, 1.2, 1.3 are fed from one or a plurality of formers 2.1, 2.2, 2.3 over feed roll groups 3,4 into a folding cylinder group 5 which is comprised generally of a plurality of cylinders. The folding cylinder group 5 comprises, for example, one 4/2 cutting knife cylinder 6, one 4/2 counter cut groove cylinder 7 cooperating with the 4/2 cutting knife cylinder 6, and one 5/2 collecting and folding blade cylinder 8. The 5/2 collecting and folding blade cylinder 8 is composed of two parts which perform two different functions. It consists particularly of a collecting cylinder 102, designed as a hollow cylinder having five equal length sections or fields 88, 89, 90, 91, 92 around its periphery, and a folding blade carrier 103 rotatably positioned inside the collecting cylinder 102.

Figure 4:
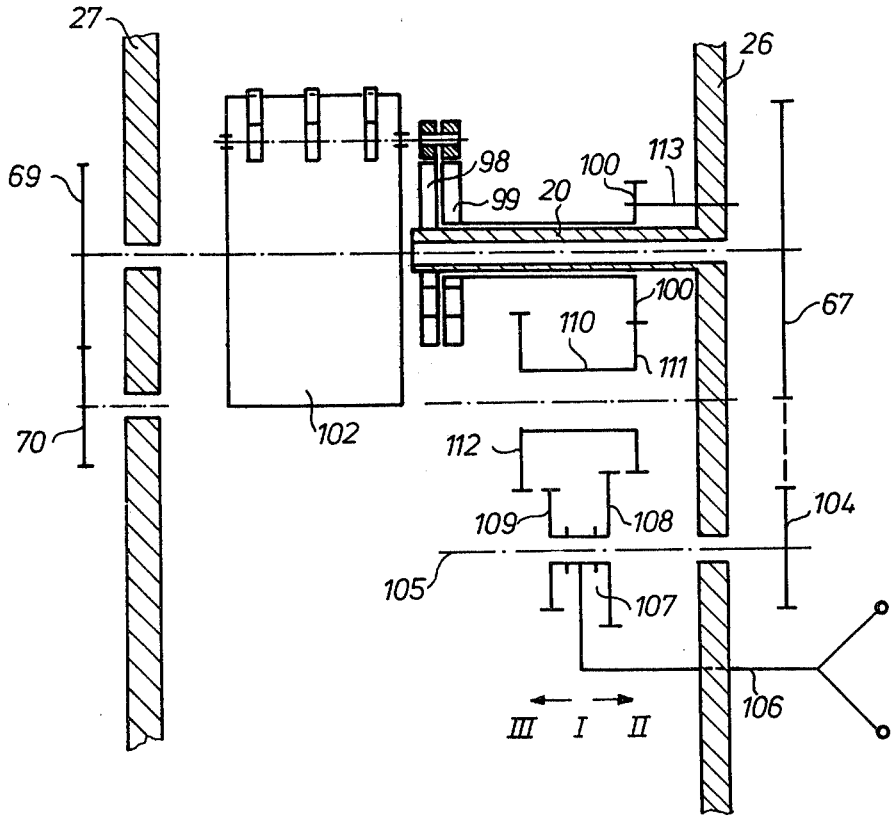
FIG. 4 is a schematical drawing of the cam disk drive portion of the gear folder of the present invention.

The 5/2 collecting cylinder 102 carries five identically spaced, controllable sets of pins 9.1, 9.2, 9.3, 9.4, 9.5 around its periphery, and the 4/2 counter cut groove cylinder 7 carries four controllable sets of pins, 10.1, 10.2, 10.3, 10.4. As the control and function of the pins 9.1 to 9.5, and 10.1 to 10.4 is generally known, for example as may be seen in the German Patent 18 01 419, control of the pins is shown in FIG. 4 in a simplified manner. The pin sets 10.1 to 10.4 carry the consolidated paper ribbons 1.2, 1.1, 1.3 onto the 4/2 counter cut groove cylinder 7, where they are then cut into four stacks of sheets 13 by four knives 11.1, 11.2, 11.3, 11.4 carried by the 4/2 cutting knife cylinder 6. These knives cooperate with four counter cut bars 12.1, 12.2, 12.3, 12.4 of the 4/2 counter cut groove cylinder 7 in a known manner. The pin sets 10.1, 10.2, 10.3, 10.4 of the 4/2 counter cut groove cylinder 7 transfer the sheet stacks 13 to the pin sets 9.1, 9.2, 9.3, 9.4, 9.5 of the 5/2 collecting cylinder 102. The pin sets 9.1 to 9.5 secure the sheet stack or a plurality of sheet stacks 13 one upon the other to the rotating 5/2 collecting cylinder 102 as it rotates around to, and beyond, a driven pair of folding rollers 14.

Figure 2:
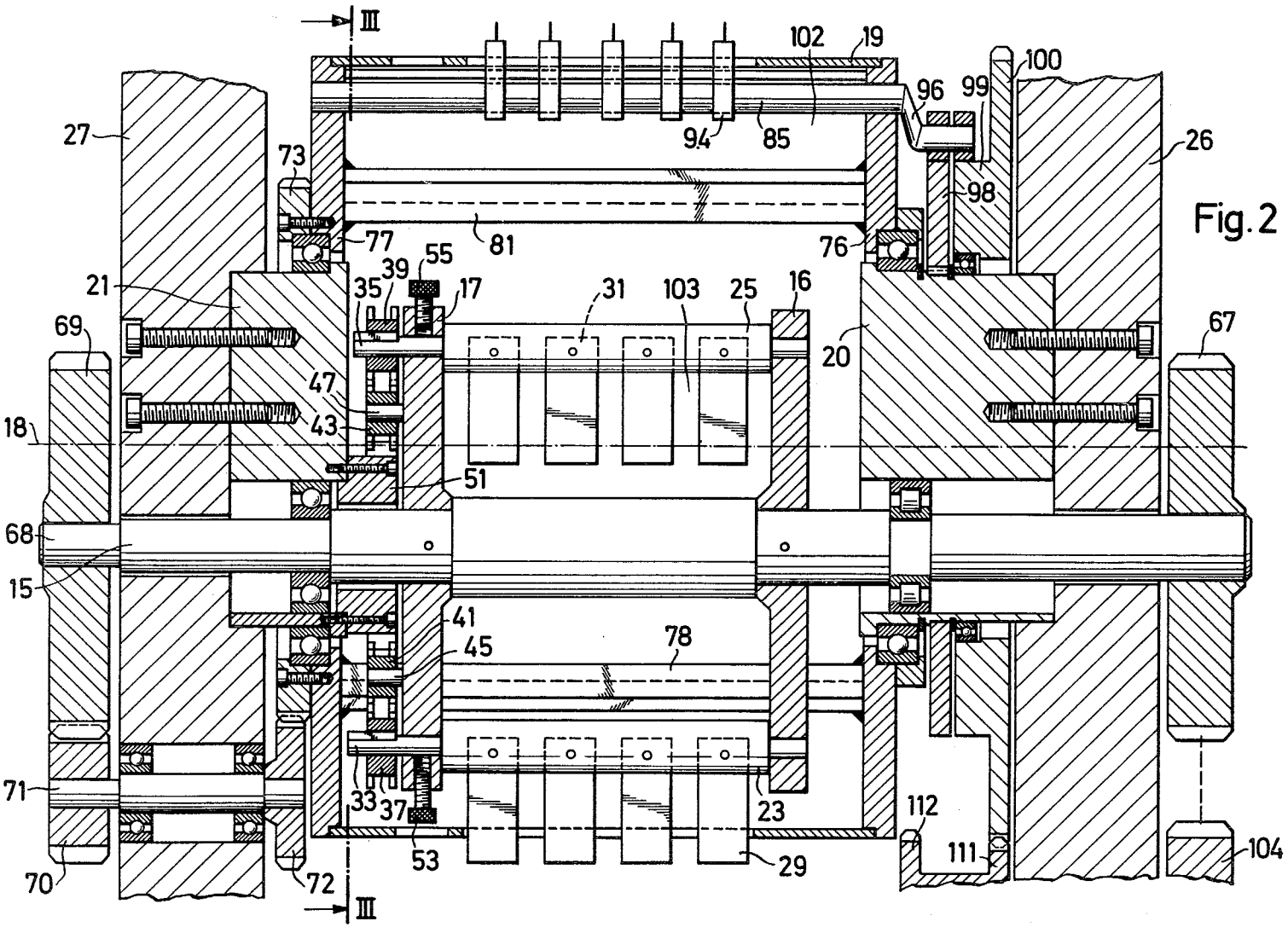
FIG. 2 is a sectional view taken along line II—II of FIG. 3 through the 5/2-collecting folding blade cylinder of the gear folder in accordance with the present invention.
Figure 3:
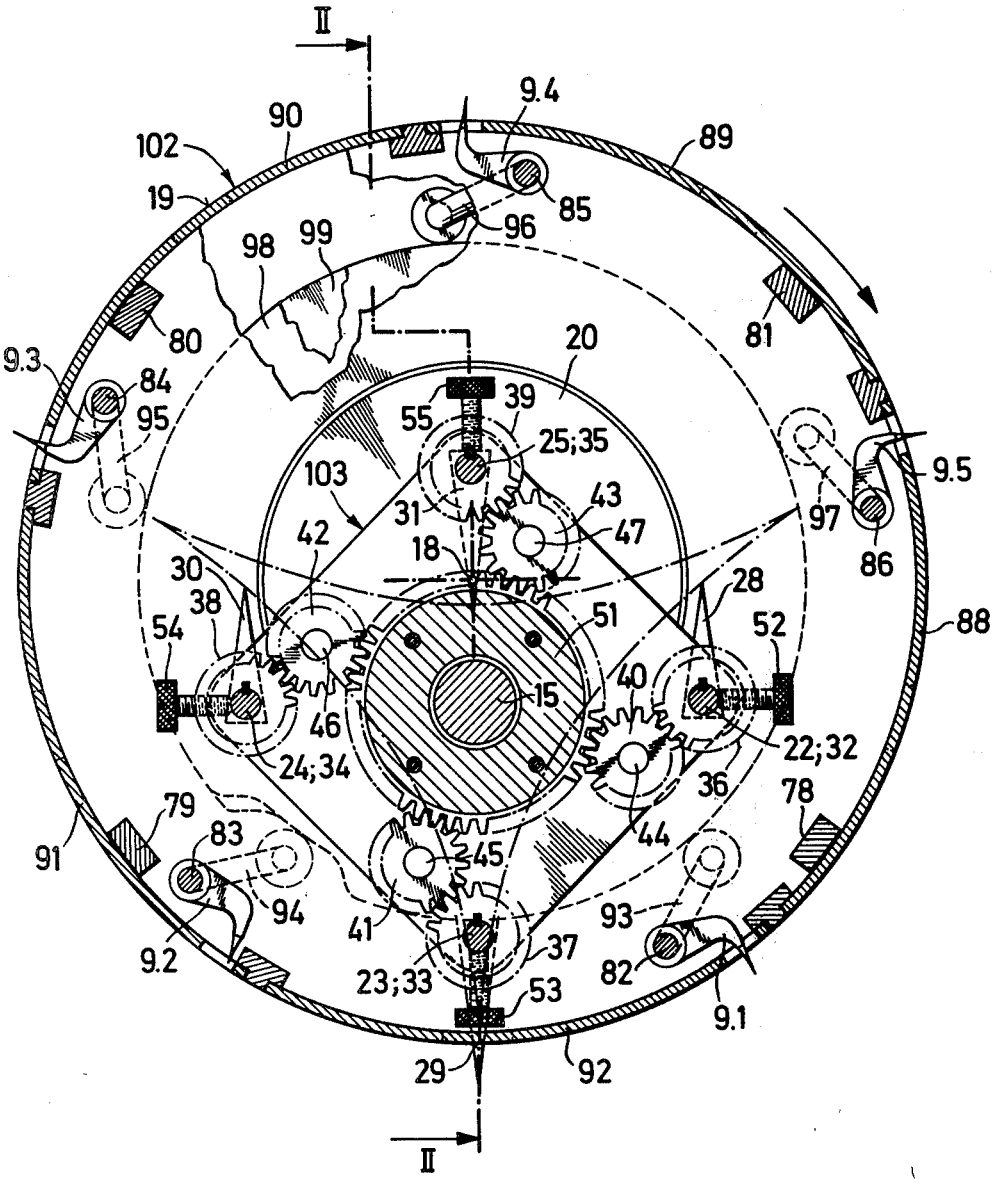
FIG. 3 is a sectional view of the collecting folding blade cylinder of the present invention taken along line III—III of FIG. 2.

A shaft 15 passes through the hollow 5/2 collecting cylinder 102 and, as may be seen in FIG. 2 and FIG. 3, shaft 15 is eccentrically disposed relative to the axis of rotation 18 of the 5/2 collecting cylinder 102, and is supported in bearing bodies 20 and 21 by means of suitable bearings. The bearing bodies 20 and 21 are supported in bore-holes in side frames 26, 27 of the folder and are secured to the side frames by suitable means such as screws so that they are unable to rotate in the bore-holes. The folding blade carrier 103 is, as may be seen in FIG. 2, carried by shaft 15 for rotation within the collecting cylinder 102.

Four shouldered folding blade shafts 22, 23, 24, 25, are supported in side plates 16 and 17 of the folding blade carrier 103 in such a way that the imagined connecting line which connects their centers, forms a square. Each of these folding blade shafts 22 to 25 carries a set of folding blades 28, 29, 30, 31 which may be secured to the folding blade shafts 22 to 25 in any known manner, but which may on the other hand, also be attached to the folding blade shafts 22 to 25 in such a way that they are capable of being easily removed from the folding blade shafts 22 to 25.

A double pinion, 36, 37, 38, 39 is secured to a corresponding multi-groove journal 32, 33, 34, 35 of each of the folding blade shafts 22, 23, 24, 25, respectively. Each of the double pinions 36, 37, 38 and 39 has a clearance between its two gear rings. Axle trunnions 44, 45, 46, 47 are fixed to the outer side of the side plate 17 of the folding blade carrier 103 and these trunnions rotatably support double intermediate gears 40, 41, 42, 43, respectively. Each of the double pinions 36–39 meshes with one of the double intermediate gears 40–43 which, in turn, mesh with the teeth of a gear ring 51 which, as may be seen in FIGS. 2 and 3 is secured to the stationary bearing block 21. The folding blade shafts 22, 23, 24, 25 and thus the folding blades 28 to 31 are rotated upon rotation of the folding blade carrier 103 due to the cooperation of the pinions 36–39, gears 40–43 and the sun gear 51. The gear ratio between gear ring 51, the stationary sun gear, and the folding blade shafts 22 to 25 is 3:1. As the journals 32 to 35 are designed as multi-groove journals, it is possible to position each of the double pinions 36 to 39 in one of two locations, and to hold them in these positions. In the first position, the double pinions 36 to 39 mesh with the double intermediate gears 40 to 43, and these gears mesh with the gear ring 51. That means that the folding blades 28 to 31 are active. In the second position, two double pinions disposed diagonally opposite to each other, for example 37 and 39, or three double pinions, for example 36, 37, 38, are displaced and held on their multi-groove journals 32 to 35 in such a manner, that they no longer mesh with the teeth of the double intermediate gear 40 to 43 coordinated to them. By means of the disengagement of the double pinions 36 to 39 from the teeth of the coordinated double intermediate gears 40 to 43, the corresponding folding blade is no longer driven. If a folding blade drive means 36 to 39 is disengaged, its folding blade shaft 22 to 25 is stopped in the side plate 17 in a neutral position, for example by means of index pins 52, 53, 54, 55, so that, for example, the folding blades 29 and 31, or 28, 29, 30, are no longer capable of protruding from the periphery of a jacket portion 19 of the 5/2 collecting cylinder 102.

Torque transmission from the main drive is executed, as may be seen in FIG. 1, over a longitudinal shaft 56, bevel gears 57, 58, vertical shaft 59, bevel gears 60, 61, cross shaft 62, bevel gear 63, double gear 64 (bevel gear plus spur gear), spur gears 65, 66 and 67 and to the shaft 15 which is secured to the spur gear 67. A spur gear 69 is secured onto the journal 68 of the shaft 15, and the spur gear 69 meshes with a spur gear 70. The spur gear 70 is secured onto the journal of a shaft 71 which is supported in the side frame 27, and a second spur gear 72 is secured on the second journal of shaft 71. A gear ring 73, which is screwed to an end disk 77 of collecting cylinder 102, meshes with the spur gear 72. The end disks 77 and 76 and the 5/2 collecting cylinder 102 are rotated by the gear ring 73, around the axis of rotation 18 of the jacket 19 of the 5/2 collecting cylinder 102, which is, at the same time, the center of the bearing bodies 20, 21. Jacket 19 has several openings, through which the folding blades 28 to 31 or the pins of the pin sets 9.1 to 9.5 may project and retract. For bracing purposes, transverse members 78, 79, 80, 81 are welded to the inner sides of the end disks 76, 77.

Pin drive shafts 82, 83, 84, 85 and 86 are supported, regularly spaced from each other in the end disks 76 and 77 and serve to drive the pin sets 9.1 to 9.5. Each of the shafts 83–86 has a free end which is secured to a roller lever 93 to 97, the rollers of which roll on a stationary cam disk 98 and on a rotating cam disk 99, so that, selectively, each fourth pin, or each second pin, or each of the pins release one sheet stack 13 into the folding rollers 14. Cam disk 98 is to be considered as stationary, because it is detachably secured to the bearing body 20, for example, by means of a springed wedge connection. The folder further includes a switching mechanism for controlling the retraction of the pin sets 9.1 to 9.5 on the 5/2 collecting cylinder 102 by controlling the speed of rotation of cam disk 99. The switching mechanism has three operating positions; position I for straight run production; position II for collect run production; and position III for double-collect run production. As may be seen in FIG. 3, each of the cam disks 98 and 99 has a generally circular periphery with only a single camming recess or surface. Since the rollers on the roller levers 93 to 97 ride on both disks, the pins of the pin sets 9.1 to 9.5 will retract only when the camming recesses of both cam disks 98 and 99 are adjacent each other, as may be seen by the retraction of pin set 9.2 in FIG. 3. Since cam disk 98 is held stationary at the position shown in FIG. 3 and since cam disk 99 is caused to rotate in a manner as will be discussed hereinafter, it may be seen that control of the speed of rotation of cam disk 99 as a function of the speed of rotation of collecting cylinder 102 is necessary to control the figuring of retraction of each pin set so as to coordinate pin set retraction with folding blade projection.

As may be seen in FIG. 2, cam disk 99 is integrally formed with a gear ring 100. Gear ring 100 is rotatably mounted on bearing body 20 by suitable bearings and is driven by gear 111. As may be seen schematically in FIG. 4, a switching mechanism for driving gear ring 100 and cam disk 99 at selected speeds with regard to the speed of rotation of the collection cylinder 102 is provided. This switching mechanism is driven by spur gear 104 which is connected by a suitable constant transmission means (not shown) to spur gear 67 which is used to drive the collecting cylinder 102 and the folding blade assembly 103. A sliding gear wheel 107 is positioned on shaft 105 of spur gear 104, and includes two gears 108 and 109, capable of being displaced into the three positions I, II and III, for example, by means of a slide rod 106. An intermediate gear 110 having two gears 111 and 112 is coordinated to the sliding wheel 107. The gear ring 100 of the cam disk 99 meshes with the gear 111. In position I of the switching gear mechanism, the sliding wheel 107 with its gears 108 and 109 is disengaged in such a manner that none of its gears is capable of meshing with the gears 111 or 112 of the intermediate gear 110. In this case, the cam disk 99 has been brought into the position shown in FIG. 3, and has been locked in place by means of a locking device 113, for example a rod in the side frame 26. In this position, the cam disk 99 and the stationary cam disk 98 are in relation to each other such that the controlling rollers of each of the roller lever 93 to 97 enter into the camming recesses of the cam disks 98 and 99, and the rollers thus retract their connected pin sets 9.1 to 9.5 of each of the five fields 88 to 92 on the collecting cylinder 102 for each revolution of the collecting cylinder. It should be noted that each pin set 9.1 to 9.5 is retracted only at the position shown in FIG. 3; i.e. when the respective field 88 to 92 is over the folding rollers 14 so that the corresponding folding blades 28 to 31 can push the sheet or stack of sheets into the folding rollers 14 for folding and transfer to a suitable delivery fan and conveyor, as seen in FIG. 1 or like means for transporting the folded product away from the gear folder.

In position II of the switching gear mechanism, the locking device 113 for the cam disk 99 is disengaged and gears 100, 111 and 108 mesh with each other. Rotating cam disk 99 is rotated at a speed such that each of the fields 88 to 92 of the 5/2 collecting cylinder 102 must complete two revolutions before both the controlling rollers of the roller levers 93 to 97 can enter into the two cam recesses of the two cam disks 98 and 99, and thus withdraw the respective pin set 9.1 to 9.5, so that the sheet stack 13 is released to the pair of folding rollers 14. It will be seen that since each field 88 to 92 has made two revolutions past counter cut groove cylinder 7, each sheet stack 13 is now comprised of two separate stacks and the folder is operating in collect run production.

In position III of the switching gear mechanism, the locking device 113 of the cam disk 99 is again disengaged. The gears 100, 111, 112 and 109 mesh in this position with each other. Each of the fields 88 to 92 of the 5/2 collecting cylinder 102 must now rotate four times before the controlling rollers of the respective roller lever 93 to 97 are at the point where the cam recesses of both cam disks 98 and 99 are adjacent so that the respective pin set 9.1 to 9.5 can withdraw, so that the sheet stack 13 is released to the folding roller pair 14. Since each field now makes four revolutions before release of the sheet stack, four separate sheet stacks are collected and the gear folder is operating in double collect run production.

Each of the folding blades 28 to 31 rotates around its own axle and around the stationary gear ring 51, thus performing a three-pointed hypocycloid, as may be seen in FIG. 1. One of the points is positioned between the folding rollers 14, whereas the other two points are positioned inside the jacket 19 of the 5/2 collecting cylinder 102. In straight run production, all the four folding blades 28 to 31 pass over the hypocycloid, shown in FIG. 3 by means of a dashed line so that with every quarter revolution of the folding blade carriers 16, 17, which coincides with every 1/5 turn of the 5/2 collecting cylinder 102, one sheet stack 13 is engaged by the folding blade 28 to 31 and is pushed into the folding rollers 14 and is released by the pin sets 9.1 to 9.5.

In collect production, two of the folding blades positioned diagonally opposite each other, for example the folding blades 28 and 30, or 29, 31, are stopped. This may be done by means of lateral displacement of the corresponding double pinions, for example 36 and 38, or of the double intermediate gear, for example 40 and 42, or by simply removing the folding blades, for example 28 and 30 from their shafts. In this mode, a folding blade projects out only after a half revolution of the folding blade carrier and thus only sheet stacks 13 on every other field 88 to 92 are pushed into the folding roller 14. Thus, every second sheet stack 13 remains on the 5/2 collecting cylinder 102. In this mode, the pin sets 9.1 to 9.5 are also controlled in the same way—that means retracting every second set—so that the sheet stack 13 not having been folded remains pinned up in immobilized pin sets and must therefore move once more around the 5/2 collecting cylinder 102. Due to the odd number of five divisions or fields of the 5/2 collecting cylinder 102, this sheet stack 13 is united with a different sheet stack which is collected with the first and not folded until the second revolution has been made.

For double collect production, three folding blades, for example the folding blades 29, 30, 31, are immobilized. Only one fold is performed with every rotation of the folding blade support, so that only every fourth 1/5 field 88 to 92 of the 5/2 collecting cylinder 102 passing by the folding rollers 14, is concerned. The pin sets 9.1 to 9.5 withdraw also only with every fourth field 88 to 92, in order to release a double-collected sheet stack 13 into the folding rollers 14. That means, that a sheet stack 13, which is pinned up onto the unoccupied fields 88 to 92 of the 5/2 collecting cylinder 102, must therefore perform three further whole rotations on the 5/2 collecting cylinder 102, before being folded and released. With every rotation a new sheet stack 13 is pinned onto the pins and on the sheet stacks 13 already on the same pins so that each four different sheet stacks are collected on 1/5 field before the folding procedure is executed with every fourth field 88 to 92 of the 5/2 collecting cylinder 102. Thus the desired effect of double collect production is obtained without any pin change.

It will be understood that the transmission ratio between the folding blade cylinder and the 5/2 collecting cylinder 102 must be chosen to ensure that the folding blades 28 to 31 perform one rotation, while the 5/2 collecting cylinder 102 performs only a 4/5 rotation.

While a preferred embodiment of a gear folder in accordance with the present invention has been fully and completely described hereinabove, it will be obvious to one of skill in the art that a number of changes in for example, the type of press used, the number of printing cylinders used, the number of cutting knives and counter cut grooves, the various supporting bearings, the folded product transfer means, and the like could be made without departing from the true spirit and scope of the present invention and that accordingly, the invention is to be limited only by the following claims.

What I claim is:

1. A gear folder for collecting sheets of paper and for folding said sheets, said gear folder including a rotatable, hollow, collecting cylinder, and a folding blade carrier rotating eccentrically within said collecting cylinder, said rotating folding blade carrier carrying four selectively projectable rotating folding blades, said folding blades of said folding blade carrier tracing a three-point hypocycloid, said hollow collecting cylinder having five fields, each of said five fields being equipped with a retractable pin set;

control means for selectively retracting each of said pin sets, said control means including a fixed cam disk having a first camming recess and a rotatable cam disk having a second camming recess, each of said pin sets being retracted only when said first and second camming recesses coincide, one revolution of said folding blade carrier coinciding with one 4/5 revolution of said collecting cylinder.

2. An apparatus according to claim 1, including means to rotate said second cam disk at a speed proportional to the speed of rotation of said collecting cylinder whereby said pin sets of selected one of said fields of said collecting cylinder are selectably retractable after one or more rotations of said collecting cylinder.

3. An apparatus according to claim 2 in which a driving means for said folding blades is provided which is capable of being disengaged.

4. An apparatus according to claim 3, in which one or more of said folding blades are engaged with said driving means while the remaining blades are disengaged.

* * * * *